US005749157A

United States Patent [19]

Leitenberger et al.

[11] Patent Number: 5,749,157

[45] Date of Patent: May 12, 1998

[54] DRYER SECTION FOR AN APPARATUS FOR THE PRODUCTION OF A PAPER WEB

[75] Inventors: Werner Leitenberger, Schlier-Wetzisreute; Helmut Heinzmann, Bohmenkirch, both of Germany

[73] Assignee: Voith Sulzer Papiermaschinen GmbH, Heidenheim, Germany

[21] Appl. No.: 771,277

[22] Filed: Dec. 20, 1996

[30] Foreign Application Priority Data

Dec. 22, 1995 [DE] Germany ..... 195 48 308.1
Jan. 26, 1996 [DE] Germany ..... 196 02 697.0

[51] Int. Cl.[6] ..... D21F 5/00

[52] U.S. Cl. ..... 34/117

[58] Field of Search ..... 34/454, 117, 118; 100/153, 163 R; 162/358.1, 358.3, 358.4

[56] References Cited

U.S. PATENT DOCUMENTS 1,951,710 3/1934 Schorger ..... 92/39
3,868,780 3/1975 Soininen et al. ..... 34/116
4,922,627 5/1990 Hernandez ..... 34/116
5,520,782 5/1996 Schiel ..... 162/358.3 X
5,551,164 9/1996 Brunnmair et al. ..... 34/117

FOREIGN PATENT DOCUMENTS 0 655 528 A2 5/1995 European Pat. Off. ..... D21F 5/04
PCT/F193/00206 11/1993 France ..... D21F 5/04

*Primary Examiner*—Henry A. Bennett
*Assistant Examiner*—Steve Gravini
*Attorney, Agent, or Firm*—Taylor & Associates, P.C.

[57] ABSTRACT

The invention is directed to a dryer section for an apparatus to produce webs of material, such as paper, carton or cardboard which shall consist of a number drying cylinders and carrier rollers, at least one dryer group which shall include at least one conveyer bend to direct the continuous material web along a meandering path around these drying cylinders and carrier rollers, and with at least one pressure cylinder to compress or smoothen the web of material. The pressure cylinder is located within the dryer group 3, 30 or 130, respectively, such that it is located within a region that is contained within the second and the second-to-last dryer cylinder of the dryer group.

15 Claims, 2 Drawing Sheets

DRYER SECTION FOR AN APPARATUS FOR THE PRODUCTION OF A PAPER WEB

BACKGROUND OF THE INVENTION

1. Field of the Invention

The present invention relates to a dryer section for an apparatus for manufacturing webs of material, and, more specifically, to a dryer section for an apparatus for manufacturing paper, carton or cardboard.

2. Description of the Related Art

The sort of dryer sections discussed here are already known, that includes also those devices that contain an implement for compressing or smoothing the web, located either at the beginning or near the end of the dryer group of a dryer section (DE 44 07 405 A1). The effectiveness of such a pressure cylinder for compressing or smoothing the material web has reportedly not always been satisfactory.

It is therefore an objective of the present invention to improve on this sort of dryer section so that the effectiveness of the pressure cylinder for compressing or smoothing the material web will be significantly increased.

SUMMARY OF THE INVENTION

The present invention provides a dryer section with a significantly more effective compression and smoothening action by installing at least one pressure cylinder which is bounded by the second and the second to last dryer cylinder in the dryer group.

Quite preferable is an embodiment of this invention including a dryer section where one of the dryer rollers is assigned to the pressure cylinder with which it effectively interacts. This arrangement minimizes the overall spatial requirements of the dryer section. Furthermore, this sort of arrangement also simplifies the construction considerably.

Another embodiment of this invention incorporates an implement to control the moisture content and/or regulate the temperature distribution within the material web before this web approaches the pressure cylinder(s). This sort of adjustment substantially improves the effectiveness of the cylinder.

The dryer section of the present invention may also include a pressure cylinder which acts directly onto the material web instead of acting through the conveyer belt that supports the material web. This sort of arrangement prevents any impressions, e.g., imprint of the profile of the conveyer belt, into the surface of the material web from occurring.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

The embodiments of dryer sections of the present invention that are described herein can generally be employed in conjunction with an apparatus to produce webs of material. For the purpose of illustrating this example it is from here on assumed that the described dryer section is a part of a machine that manufactures paper.

Figure 1:
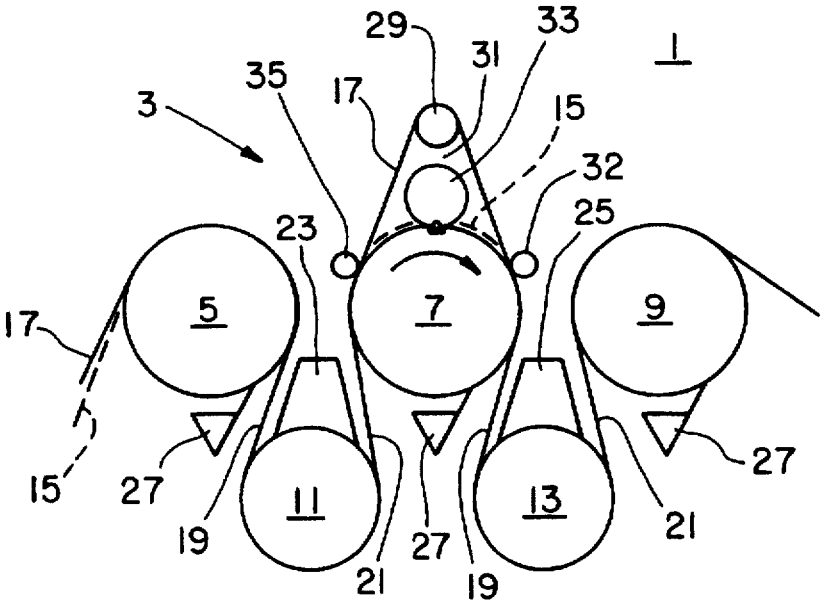
FIGS. 1, 2, 3 and 4 depict schematic side views of alternate embodiments of a dryer section of the present invention.

FIG. 1 shows a schematic side view of one particular part of a dryer section 1, more specifically, a side view of a section of the dryer group 3. This dryer group includes a number of different dryer cylinders 5, 7 and 9 whose centers are located in one plane. Below these dryer cylinders 5, 7 and 9 are carrier rollers 11 and 13 whose centers are located in a plane which in turn is parallel with the previously mentioned plane. The distance between the two planes is adjusted to provide several unobstructed paths 19 and 21 in-between the dryer cylinders 5, 7 and 9, and the corresponding carrier rollers 11 and 13. The material web 15, sketched as a dotted line near the oncoming side of the revolving dryer cylinder 5, is allowed to move through these openings and then further along a meandering path around the dryer cylinders 5, 7 and 9 and the carrier rollers 11 and 13. The clearance in-between these rollers must be wide enough to allow passage of the material web together with a conveyer belt 17 along its side to press and stabilize it. This conveyer belt 17 will from now on also be referred to as a flexible drying sieve. The four paths of free passage 19 and 21 are basically interrupted by the turn of the material web and the flexible drying sieve around carrier rollers 11 and 13. As shown in FIG. 1, it is possible that two suction boxes 23 and 25 can be placed in-between these two path segments so that they produce a negative pressure which sucks the material web towards the conveyer belt and thus stabilizes the transport of the web of material.

FIG. 1 also depicts some scrapers 27 which are commonly employed to keep incoming paper away from the surface of the dryer cylinders 5, 7 and 9. The diameters of the dryer cylinders 5 and 9 are kept a little larger than the diameters of the carrier rollers 9 and 11. The ratio of the diameters to one another can be adjusted to the material properties of the web. It is also an option to use the same diameter for the dryer cylinders and the carrier rollers so that the carrier rollers could potentially be replaced by dryer cylinders. It is furthermore possible to construct the carrier rollers 9 and 11 such that the material is sucked against the surface of these carrier rollers 9 and 11 in order to stabilize the transport of the material web through the apparatus.

Provisions are furthermore made for a guide roller 29 located a specific distance above the dryer cylinder 7. This guide roller 29 basically detaches the conveyer belt 17 from the web of material 15. While the conveyer belt travels quite a long distance away and then back to the dryer cylinder 7, the material web 15 actually sticks directly to the surface of the dryer cylinder 7. The conveyer belt being pulled away from the dryer cylinder 7 actually creates a little free space 31.

The way in which the material web 15 comes into direct contact with the dryer cylinder 7 permits the moisture to evaporate without any obstructions. A further advantage is created by the fact that the conveyer belt 17 does for a brief moment not press the material web 15 against the surface of the dryer cylinder 7. This allows the web to shrink a little which decreases the residual tensile stresses into the transverse direction within the web.

FIG. 1 illustrates how a pressure cylinder 33 can be fitted into the free space 31. This pressure cylinder 33 is juxtaposed to the dryer cylinder 7, so that their adjoining surfaces press against each other. It is furthermore suggested to wrap some soft synthetic fabric around the pressure cylinder 33 which helps conform the mating surface of the pressure cylinder 33 to the contour of the dryer cylinder 7.

The close contact between the pressure cylinder 33 and the dryer cylinder 7 effectively smoothens the web of material 15, and the compression helps densify the material web 15. This sort of effect lets the dryer cylinder 7 also act as a smoothening cylinder.

It is conceivable that if the free space 31 is large enough and appropriately shaped, a dehydration band (not shown in FIG. 1) may be placed in-between the cleft between the pressure cylinder 33 and the dryer cylinder 7. Such a dehydration band would help to reduce the moisture level in the material web by absorbing the water that is mechanically squeezed out of the web by the combined action of the pressure cylinder 33 and the dryer cylinder 7. In such an arrangement the pressure cylinder 33 acts as a compression implement that effectively increases the density of the material web. The densification of the material further improves the degree of dryness, especially if the material is some sort of porous paper. In yet another configuration of this dryer section, the pressure cylinder 33 can be fabricated so that its surface absorbs liquids. It is possible, for example, that the surface of the cylinder is made out of something porous, thus allowing it to absorb water. Such a design would eliminate the use of a dehydration band.

To ensure that the conveyer belt 17 wraps around a portion of the dryer cylinder 7, two support rollers 35 and 37 can be placed—looking along the travel direction of the material web—before and after the guide roller 29. This provision also helps to reduce the extent of the free space 31. It is also possible to control the number, location and the extent of the arc segment along which the conveyer belt 17 wraps around the dryer cylinder 7 by appropriately placing the support rollers 35 and 37. The support rollers 35 and 37 can be located, for example, so that the conveyer belt 17 contacts a particularly large portion of the surface of the dryer cylinder 7. This effectively increases the drying capacity of the dryer section without making any further adjustments to the apparatus or adding any additional features.

Figure 2:
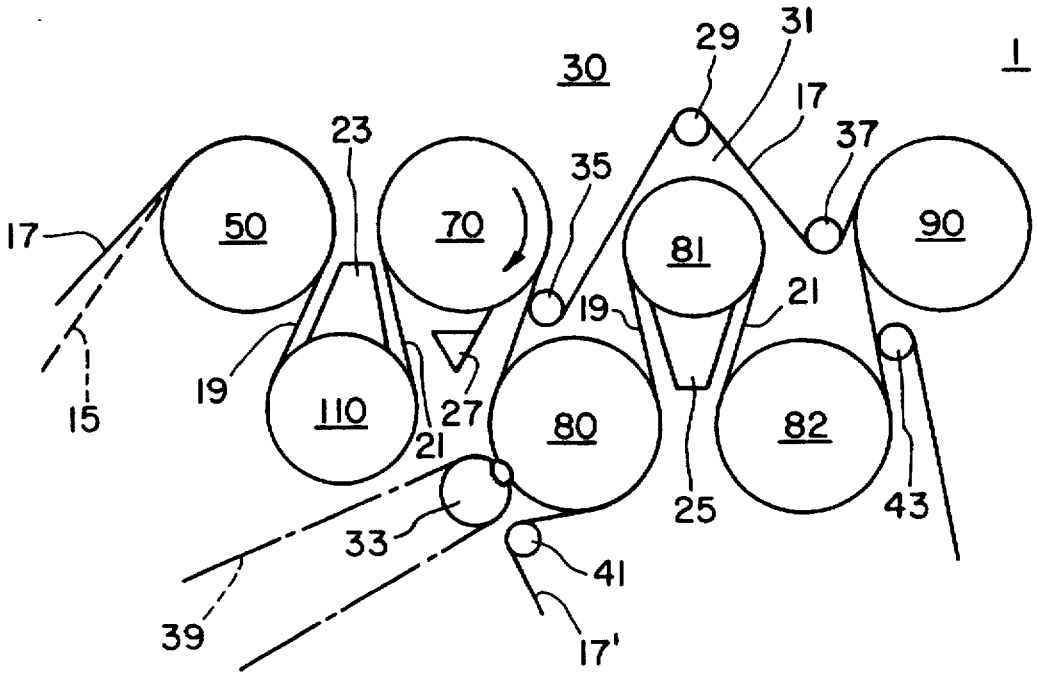

FIG. 2 shows a side view section of a dryer section with a modified dryer group 30. This dryer group 30 includes dryer cylinders 50, 70 and 90 located in an upper plane as well as dryer cylinders 80 and 82 in a somewhat lower plane. In addition, there are provisions made for a first carrier roller 110 that is located just below the dryer cylinders 50 and 70, and a second carrier roller 81 which is placed just above the dryer cylinders 80 and 82. The web of material 15 is indicated with a dotted line near the dryer cylinder 50 on the side where the conveyer belt and material web wrap onto dryer cylinder 50. The web of material is guided, while in close contact with the conveyer belt, in a meandering way around the dryer cylinders 50, 70, 80, 82 and 90 as well as around the carrier rollers 81 and 110. FIG. 2 shows two free spaces within the so called free paths 19 and 21 where material travels around carrier rollers 81 and 110. They are referred to as free paths because for these short distances neither the web of material nor the conveyer belt are supported by any rollers or cylinders. These free spaces are again utilized for suction devices 23 and 25 which serve to stabilize the passage of the material web 15. The dryer section 30 is equipped, as before, with scrapers 27, of which only one example is shown. They serve again to keep incoming paper away from the surface of the dryer cylinders, and prevent it from getting tangled around the dryer cylinders.

The diameters of carrier rollers 110 and 81 are kept a little smaller than the diameters of the dryer cylinders 50 and 90. It is also an option to use the same diameter for the dryer cylinders and the carrier rollers, so that the carrier rollers could potentially be replaced by dryer cylinders. It is furthermore possible to construct the carrier rollers 110 and 81 with suction acting from within to prevent the material web 15 from becoming detached.

A guide roller 29 is placed above the carrier roller 81. It is the purpose of guide roller 29 to lead the conveyer belt 17 at a specific distance away from the carrier roller 81. In addition to that, support rollers 35 and 37 are incorporated to determine the location and the extent of the arc segment along which the material web 15 and the conveyer belt 17 wrap around the dryer cylinders 70 and 90, respectively. At the same time the support rollers 35 and 37 define the extent and shape of the free space 31, located just above the guide roller 29. The top border of this free space 31 is outlined by the conveyer belt 17, while the bottom border is defined by the open surface of the dryer cylinders 80 and 82. The side borders of the free space, on the other hand, are defined by the so called free paths 19 and 21 where the web of material 15 travels unsupported by any rollers as well as the path taken by the material web 15 as it is guided over the carrier rollers 81. The support rollers 35 and 37 may potentially be utilized to control the free tension acting between the two dryer cylinders 70 and 80, or between another set of two dryer cylinders 70 and 80, respectively, i.e., generally to minimize these tensile forces. Such adjustments in tension are essential for producing webbed material at a fast rate without sacrificing control over the movement of the web. Further, the location of the support rollers may be influenced by the desired arc of contact between the material web 15 and the conveyer belt 17 as they wrap around the dryer cylinders, or the location of the support rollers may be influenced by the amount of free tension acting between adjacent dryer cylinders. Such arrangements optimize the manufacturing process of the material webs.

As the material web 15 travels unsupported by any rollers through the so called free space, moisture is allowed to freely evaporate from the unobstructed surface of the material web. Since the web is not constrained by any transverse forces pressing it against the surface of the carrier rollers 81, it is in a position to shrink. This inhibits the development and actually enables for brief moments the relaxation of residual stresses in the transverse direction.

If the free space is constructed such that the center axis of the guide roller 29 is sufficiently far enough away from the center axis of the carrier roller 81, then there is in this version of the dryer section room enough to incorporate a pressure cylinder 33 into the free space 31, as it was described in FIG. 1 for the previous version. In the following example, illustrated in FIG. 2, the pressure cylinder 33 is depicted adjacent to the dryer cylinder 80 at an arc segment where the material web 15 travels along the surface of the dryer cylinder, not accompanied by the conveyer belt 17. A line consisting of dots and dashes illustrates how a dehydration band 39 could be inserted between the pressure cylinder 33 and the dryer cylinder 80 so that it would run for a brief part of the way adjacent to the material web 15. The pressure exerted upon the material web 15 by the force of the pressure cylinder 33 pushing against the dryer cylinder 80 squeezes some of the moisture out of the material web 15, which then is absorbed by the dehydration band 39. The pressure cylinder 33 acts in this arrangement as a compression unit. Without the dehydration band 39, the pressure cylinder 33 merely acts as a smoothening implement. The pressure cylinder 33 can be constructed so that its surface is made out of a porous material. This makes the surface itself into an alternative tool to absorb moisture that could replace the dehydration band 39, just as it was explained in the previous version.

Another improvement feature is the second conveyer belt 17' that acts as a support to prevent the web of material 15 from detaching from the dryer cylinders 80 and 82. The path of the second conveyer belt 17' is shown to lead through carrier rollers 41 and 43, around a portion of the dryer cylinder 80, along the free path 19 to the carrier roller 81, and then along the second free path 21 to another dryer cylinder 82. The dryer group 30 is therefore in parts developed into a double lined dryer group. The previous dryer group 3, shown in FIG. 1 is therefore in contrast a simple "top felted" dryer group, where the conveyer belt 17 is guided above the dryer cylinders 5 through 9, up to the beginning of the dryer group 3. The dryer group 30, as it is shown in FIG. 2, must also be regarded as a quasi, single line, "top felted" dryer group within the regime of the dryer cylinders 50 and 70. More dryer cylinders can be added onto the dryer group 30 next to the dryer cylinder 90, so that this would then also be considered as quasi, single line, and "top felted" group. The possibility also exists to divide the dryer group before the dryer cylinder 50, and after the dryer cylinder 90, thus creating two separate group entities.

Figure 3:
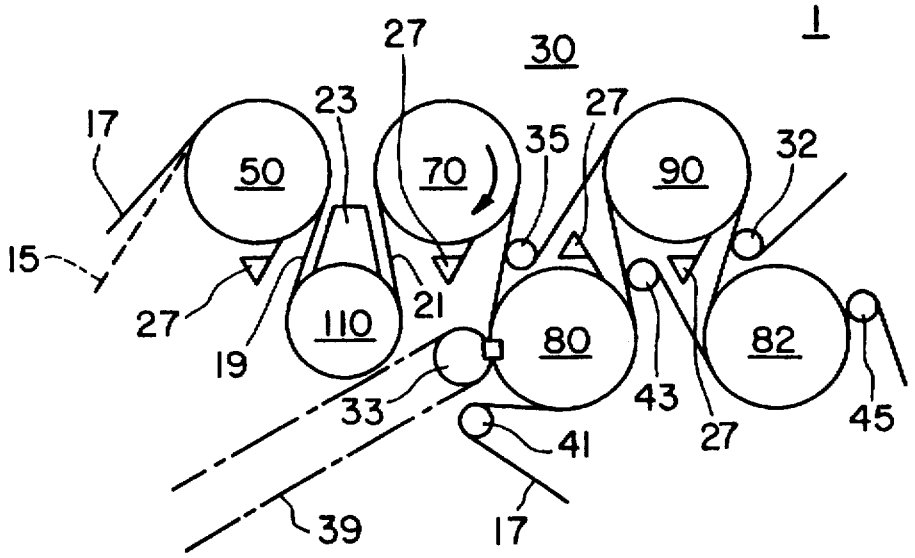

FIG. 3 is a simplified representation of the dryer group which was previously shown in FIG. 2 as dryer group 30. Since the same configurations are shown in FIGS. 2 and 3, the same reference numbers are used for the corresponding elements. The dryer group 30 in FIG. 3 shows again a number of dryer cylinders 50, 70 and 90, located along an upper horizontal plane. Dryer cylinders 80 and 82 are lined up along a lower horizontal plane where they are stacked in alternating steps between the upper cylinders 70 and 90, and after cylinder 90, respectively. A carrier roller 110 is shown placed in the same position as before, between the dryer cylinders 50 and 70. A suction device 23 is inserted between the so called free paths 19 and 21 to and from the carrier roller 110. The suction device 23 is applied to the carrier roller 110, and is used to stabilize the movement of the material web 15 as it traverses the free paths 19 and 21.

A support roller 35 is placed—looking along the travel direction of the conveyer belt 17—after the dryer cylinder 70. Following this, the conveyer belt 17 moves from the support roller 35 directly to the next dryer cylinder 90, and wraps around a portion of the dryer cylinder 90 before it is taken up by a second support roller 37 which is placed adjacent to the second dryer cylinder 90. The web of material 15 moves along a meandering path around the dryer cylinder 50, then the carrier roller 110, and then around another dryer cylinder 70. The material web 15 then winds around the lower dryer cylinder 80, next around the upper dryer cylinder 90, and finally around the lower dryer cylinder 82. For additional support a second conveyer belt 17' is utilized in the regime of the lower dryer cylinders 80 and 82, in order to press the material web 15 against the surfaces of these lower dryer cylinders 80 and 82 while carrier rollers 41, 43 and 45 help to keep the conveyer belt 17' along the right path.

The dryer group 30 is provided with scrapers 27 which are acting on the surfaces of the dryer cylinders 50, 70 and 90, as well as the dryer roller 80. Also the dryer cylinder 82 is equipped with a scraper.

A pressure cylinder 33 is installed at a location where the material web 15, while not being supported by either of the conveyer belts, is winding around the dryer cylinder 80. The purpose of the pressure cylinder 33 is to press the material web 15 against the dryer cylinder 80. A dehydration band 39 is inserted in-between the pressure cylinder 33 on one side and the dryer cylinder 80 as it is indicated by a line of dots and dashes (FIGS. 2 and 3). The function of the dehydration band 39 is to absorb the moisture that is being squeezed out of the material web 15. In such an arrangement, the dryer cylinder 80 acts as a smoothening cylinder. If the surface of the dryer cylinder 80 is made out of a porous substance, the dehydration band 39 may be eliminated.

FIGS. 1 through 3 show versions of a dryer section where the pressure cylinder 33 acts in conjunction with a dryer cylinder. The walls of the dryer cylinder preferably are enforced in order to take the pressure of the pressure cylinder 33. Also the bearing of the dryer cylinder needs to be enforced accordingly in order to sustain the pressure of the pressure cylinder 33. It is furthermore possible to incorporate deflection control into the dryer cylinder in order to compensate for the deflection of the larger dryer cylinder caused by the force exerted by the smaller pressure cylinder 33, and in order to develop a certain distribution of the compressive forces across the section of the cylinder. It is also possible to vary the force with which the pressure cylinder pushes on the material web in order to adjust the pressure to a desired value.

Figure 4:
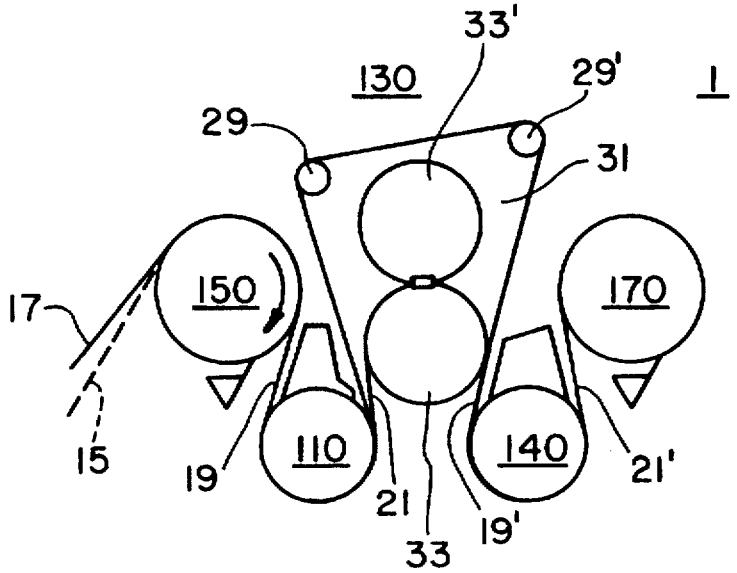

FIG. 4 shows a sectional side view of another dryer section with a modified dryer group 130, of which two dryer cylinders 150 and 170 are depicted which are situated in a horizontal plane. The sketch also shows two carrier rollers 110 and 140 in a somewhat lower plane. These carrier rollers 110 and 140 are displaced by a certain distance in the direction of the "overall movement of the material web" within the machine, which is indicated by a double arrow at the bottom of FIG. 4. A dashed line indicates the material web 15, supported by the conveyer belt 17, as it is in the progress of winding onto the dryer cylinder 150. From here, the material web 15 and the conveyer belt 17 travel unsupported by any roller or cylinder across a so-called free path 19, and onto another carrier roller 110. The material web 15 and the conveyer belt 17 then wind together from the carrier roller 110 before they embark on a second free path 19'. The material web 15, which traveled outside of the conveyer belt 17 around the carrier roller 110, then adheres to a first pressure cylinder 33, and then in-between a gap formed by this first pressure cylinder 33, and a second pressure cylinder 33', which is located just above the first pressure cylinder 33. In the mean time, the conveyer belt 17 extends along a separate path. To wit, the conveyer belt 17 is picked up by two widely spaced out guide rollers 29 and 29', which carry it along a path that describes a large free space 31. The two pressure cylinders 33 and 33' are confined within this free space 31, bordered by the path of the conveyer belt 17. The material web 15 and the conveyer belt 17 then join back together and travel along another free path 19', which brings the material web from the surface of the pressure cylinders 33 to the surface of the carrier roller 140. From there, the material web 15 and the conveyer belt 17 move along another "free path" 21' to another dryer cylinder 170.

The embodiment shown in FIG. 4 is characterized by the fact that the pressure cylinder 33 does not act together with the surface of a dryer cylinder but instead with the surface of another pressure cylinder 33'. The material web 15 is led in-between these two pressure cylinders 33 and 33', which act as smoothening cylinders onto the material web 15. A slightly different arrangement which is not shown in FIG. 4 employs a dehydration band that moves along with the material web 15 in-between these two pressure cylinders 33 and 33', which would in this case act as compression cylinders onto the material web 15.

It follows from the above description that pressure cylinders 33, which were before explained and are shown in FIGS. 1 through 3, can also act in conjunction with carrier rollers, especially when these carrier rollers are enforced to withstand the compressive forces.

It is common to all these versions of the present invention that the dryer group has at least one pressure cylinder which acts onto the material web in order to help squeeze some of the water out of this web, thus acting as a compression cylinder. In contrast, the pressure cylinder can also smoothen the surface of the material web and densify it, thus acting as a smoothening cylinder instead. The dryer group can be constructed in an especially compact fashion if a pressure cylinder is installed into the "free space" that is formed by separating the material web 15 from the conveyer belt 17, and leading the conveyer belt 17 by means of one or more guide rollers 29 or 29', respectively, around a path that basically describes the circumference of this "free space". The separation maneuver can only be executed in such a way that the conveyer belt is lifted up or carefully moved away from the material web as both are near a dryer cylinder. Else it is possible to separate the conveyer belt from the material web by leading both of them freely above a dryer cylinder or a carrier roller, such as is illustrated in FIG. 2.

By making special arrangements for the placement of the pressure cylinder within the confines of the dryer group it is possible to gain particularly good control over the moisture content in the material web and also to improve the quality of the surface of the material web. This dryer group allows a certain moisture content and a desired surface quality for the material web before the web moves on to another dryer group. The moisture content and the quality of the surface of the web of material can thus very well and very accurately be predicted and they can be varied to what ever is desirable for a given product. It is possible to predetermine the moisture content and the quality of the surface which the web of material will attain within the range of a dryer group, independent of the way in which the material web is transferred to the next group. A dryer group of this sort can thus be randomly combined with other dryer groups without any repercussions to the outcome of the moisture content and the quality of the surface of the web of material by the way the groups are configured with respect to one another. It is also possible to integrate such a dryer group at any location within a dryer section and to choose the location for the placement of the pressure cylinders only by criteria dictated by the moisture content and the material properties of the web of material.

It is furthermore common to all the above mentioned versions of this invention that an implement to balance the moisture level and/or temperature distribution across the web of material 15 is installed in front of the pressure cylinder 33, which in turn smoothens the material web 15. Especially notable is an arrangement that utilizes a steam blower box, which blows steam onto the material web 15 before this passes through the smoothening slot that is formed by the pressure cylinder. This sort of arrangement can be employed for the case where a pressure cylinder is working in conjunction with a dryer cylinder or a carrier roller, as well as for the case where two smoothening cylinders 33 and 33' are working in conjunction with one another.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A dryer section in an apparatus used for the production of a continuous material web, said dryer section comprising:

at least one dryer group including a plurality of dryer cylinders and carrier rollers, each said dryer group also including at least one conveyer belt carried by said plurality of dryer cylinders and said carrier rollers, said conveyor belt directing the continuous material web around said plurality of dryer cylinders and carrier cylinders and defining a direction of travel through said dryer group; and at least one pressure cylinder positioned in association with one of said plurality of dryer cylinders and carrier rollers, said at least one pressure cylinder compressing or smoothening the material web, said pressure cylinder contained within a region between a second and a second-to-last one of said dryer cylinders, relative to the direction of travel through said dryer group.

2. The dryer section of claim 1, wherein each said pressure cylinder is positioned adjacent to and works in conjunction with one of said plurality of dryer cylinders.

3. The dryer section of claim 2, wherein at least one of said dryer cylinders and said pressure cylinders is deflection controlled.

4. The dryer section of claim 1, wherein each said pressure cylinder is positioned adjacent to and works in conjunction with one of said plurality or carrier rollers.

5. The dryer section of claim 4, wherein at least one of said carrier rollers is deflection controlled.

6. The dryer section of claim 1, wherein said at least one pressure cylinder comprises two pressure cylinders which coact with one another, and wherein the material web passes between said two pressure cylinders.

7. The dryer section of claim 1, further comprising a dehydration belt which works in conjunction with one of said pressure cylinders.

8. The dryer section of claim 1, further comprising a means for at least one of balancing the moisture level and distributing the temperature of the material web along a cross section of the material web.

9. The dryer section of claim 8, wherein said balancing and distributing means comprises a steam blower box.

10. The dryer section of claim 1, wherein each said pressure cylinder bears directly upon the material web.

11. The dryer section of claim 1, further comprising at least one guide roller which separates said conveyer belt from the material web and directs said conveyor belt along a path defining a free space.

12. The dryer section of claim 11, wherein one of said pressure cylinders is located within said free space.

13. The dryer section of claim 11, further comprising a pair of support rollers which are placed before and after said guide roller, relative to the direction of travel through said dryer group.

14. The dryer section of claim 13, wherein one of said pressure cylinders is located within said free space.

15. The dryer section claim 1, wherein said at least one pressure cylinder comprises a plurality of pressure cylinders, and wherein at least one of said pressure cylinders defines a compression implement, and wherein at least one other of said pressure cylinders defines a smoothening roller.

* * * * *